United States Patent [19]

Skinner

[11] 4,282,844

[45] Aug. 11, 1981

[54] FUEL PUMPING APPARATUS

[75] Inventor: Robert T. J. Skinner, High Wycombe, England

[73] Assignee: Lucas Industries Limited, Birmingham, England

[21] Appl. No.: 110,682

[22] Filed: Jan. 9, 1980

[30] Foreign Application Priority Data

Feb. 17, 1979 [GB] United Kingdom ..... 5660/79

[51] Int. Cl.[3] ..... F02D 1/06

[52] U.S. Cl. ..... 123/502; 123/179 L; 123/366; 123/368; 417/219

[58] Field of Search ..... 123/501, 502, 500, 179 L, 123/366, 368; 417/213, 219

[56] References Cited

U.S. PATENT DOCUMENTS

| | | | |
|---|---|---|---|
| 2,230,487 | 2/1941 | Eideneier | 123/502 |
| 3,024,779 | 3/1962 | Hogeman | 123/501 |
| 3,147,746 | 9/1964 | Höfer | 123/502 |

FOREIGN PATENT DOCUMENTS

| | | | |
|---|---|---|---|
| 60405 | 1/1938 | Norway | 123/501 |

*Primary Examiner*—Charles J. Myhre
*Assistant Examiner*—Carl Stuart Miller

[57] ABSTRACT

A fuel pumping apparatus for a compression ignition engine includes a fluid pressure operable piston for determining the timing of delivery of fuel. Fuel control means is provided which includes a lever operable to increase the idling speed of the engine when cold. The apparatus also includes a mechanism operable by said lever to achieve from the hot idling position retarding the timing of delivery for starting and advancing of the timing of delivery for cold idling. The mechanism includes a pair of members the one member being movable by said lever and the faces of the members having tang and slot connections in their presented faces and the other member and the end of the piston having further tang and slot connections. The slot of one of said tang and slot connections being of varying depth.

4 Claims, 3 Drawing Figures

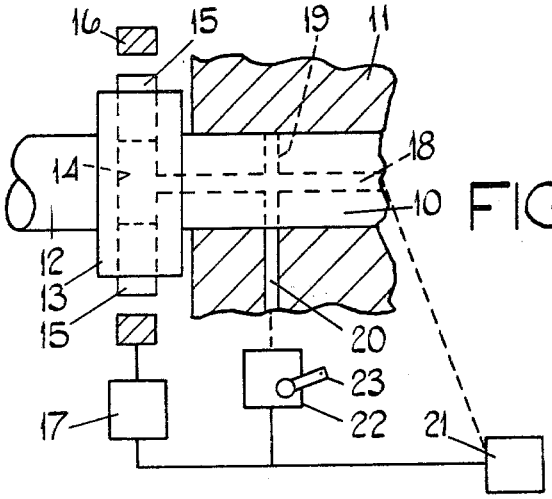
FIG. 1.
FIG. 2.
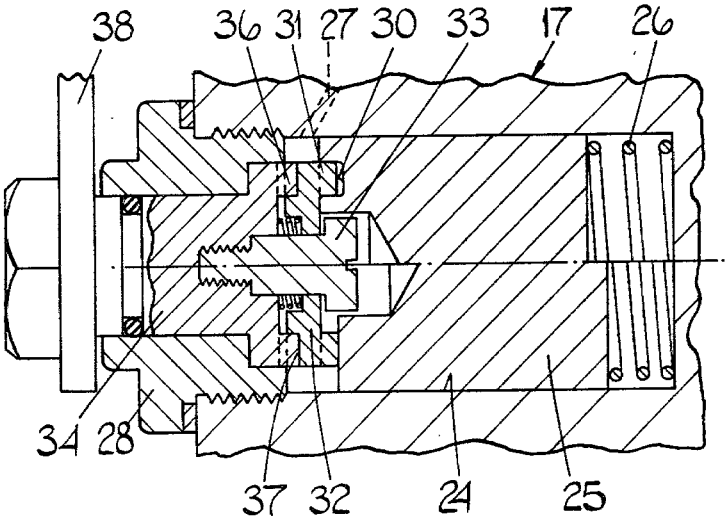

FUEL PUMPING APPARATUS

This invention relates to a fuel pumping apparatus for supplying fuel to a compression ignition engine and of the kind comprising an injection pump operable in use, in timed relationship with the associated engine to deliver fuel at predetermined time intervals, the injection pump including a component the position of which can be altered to adjust the timing relationship between the injection pump and the engine, an engine speed responsive member operably connected to said component and which with increasing engine speed moves said component in a direction to advance the timing of delivery of fuel by the injection pump, fuel control means for controlling the amount of fuel delivered by the injection pump and lever means associated with said fuel control means and operable to increase the amount of fuel delivered by the injection pump for the purpose of obtaining satisfactory idling of the engine when the engine is cold.

It has been found for some engines that for satisfactory idling when the engine is cold, the timing of delivery should be advanced as compared with the timing when the engine is hot. It is known to arrange for the aforesaid lever means when operated to increase the delivery of fuel, to advance the timing of delivery of the fuel. However, it has been found desirable when starting the engine to retard the delivery of fuel and the object of the present invention is to provide an apparatus of the kind specified in a form in which this desideratum can be achieved.

According to the invention an apparatus of the kind specified comprises a first member positioned adjacent said speed responsive member, a second member positioned adjacent said first member means coupling said second member to said lever means whereby when said lever means is moved in a direction to increase the delivery of fuel for cold idling purposes, said second member will be moved in a plane normal to the direction of movement of said speed responsive member, first tang and slot elements defined by the presented faces of the speed responsive members and the first member, second tang and slot elements defined by the presented faces of the first and second members, one of said tang and slot elements having the slot wider than the tang and of varying depth and resilient means acting between the pair of members defining the aforesaid one tang and slot elements, said resilient means acting to urge the members in a direction such that the tang is disposed at the shallower end of the slot, the arrangement being such that when said lever means is moved to increase the delivery of fuel the aforesaid pair of members move relative to each other so that the tang moves to the deeper end of the slot thereby allowing the members to move closer to each other so that the timing of delivery of fuel is retarded, and when the engine starts the other members move away from each other to disengage the other tang and slot elements whilst the one pair of members move relative to each other under the action of the resilient means, thereby providing advance of the timing of delivery of fuel for cold idling of the engine.

An example of an apparatus in accordance with the invention will now be described with reference to the accompanying drawings in which:

FIG. 1 is a diagrammatic representation of the apparatus,

FIG. 2 shows in cross section, a part of the apparatus seen in FIG. 1 and,

Figure 3:
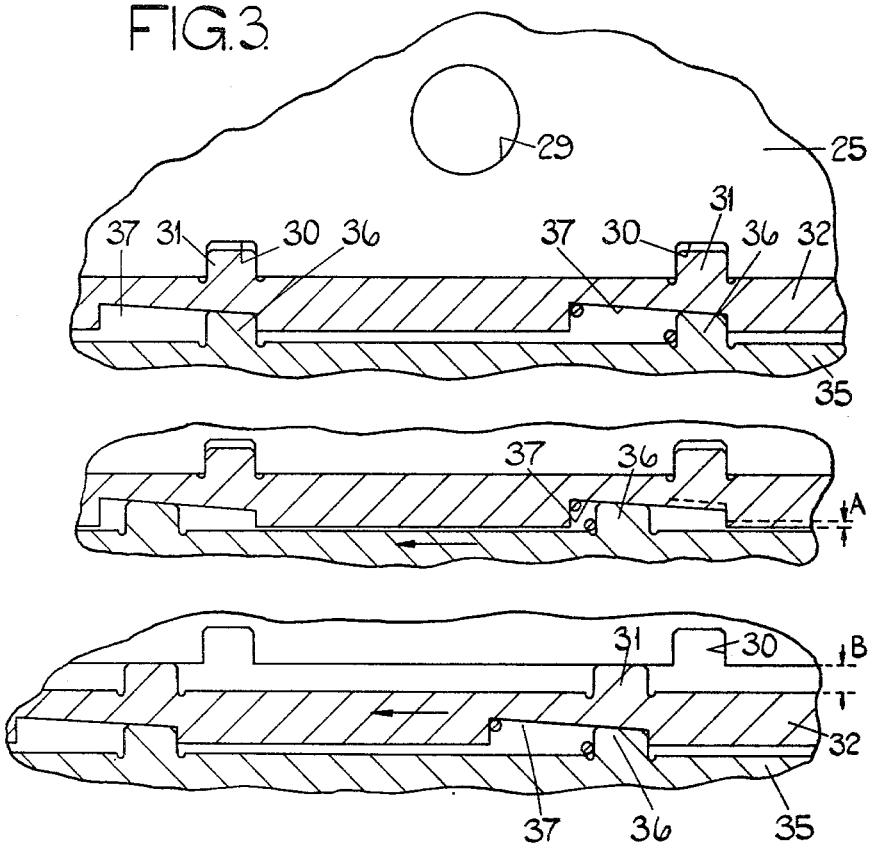
FIG. 3 shows three views representing various settings of parts of the apparatus seen in FIG. 2.

With reference to FIG. 1 of the drawings the fuel pumping apparatus includes a rotary cylindrical distributor member 10 which is located within a body 11. The distributor member is coupled to a drive shaft 12 which in use, is driven by the associated engine. The distributor member also carries a head 13 in which is formed a transversely extending bore 14 which carries a pair of plungers 15. The plungers 15 are moved inwardly through the interaction of rollers and cam lobes (not shown), the cam lobes being formed on the internal peripheral surface of an annular cam ring 16. The cam ring 16 is angularly moveable about the axis of rotation of the distributor member by means of an engine speed responsive member indicated at 17 and which will be described in further detail.

The distributor member is provided with a longitudinal passage 18 which communicates with a delivery passage, (not shown) and this in turn can communicate in turn during the time when the plungers are moved inwardly, with one of a series of outlets (not shown) formed in the housing and connected in use to the injection nozzles of the associated engine.

The longitudinal passage 18 is also in communication with a plurality of inlet passages 19 which can register in turn with an inlet port 20 formed in the housing. The communication of an inlet passage 19 with the inlet port 20 takes place during the period when the plungers 15 are allowed to move outwardly.

Fuel under pressure is supplied to the inlet port 20 from a fuel feed pump 21 which has a rotary part driven from or formed integrally with the distributor member 10. In addition the pump 21 incorporates a relief valve whereby the output pressure of the pump varies in accordance with the speed at which the distributor member rotates and therefore the engine speed.

The outlet of the pump 21 is connected to the port 20 through fuel control means indicated at 22. The fuel control means may include a throttle member the setting of which is determined at least in part by a speed responsive governor and by an operator adjustable member (not shown). The governor will control the amount of fuel supplied to the engine for the purpose of idling and will also control the maximum speed of the engine.

It has been found that when the associated engine is cold more fuel should be supplied to the engine for the purpose of obtaining satisfactory idling, than when the engine is hot and for this purpose a manually operable lever 23 is provided on the fuel control means and which in use, is connected to an operator adjustable control which the operator of the engine moves to an operative position when starting the engine from cold. When the engine is hot the control can be returned to the inoperative position and once this has taken place the fuel control means ensures that a reduced quantity of fuel is supplied to the engine for the purpose of idling. It should be emphasised that the lever 23 influences only the amount of fuel supplied for idling purposes.

Turning now to the speed responsive member 17, this is shown more clearly in FIG. 2, and with reference to this Figure there is provided a cylinder 24 in which is located a piston 25. The piston 25 is operatively connected to the cam ring 16 this being achieved by means of a radial peg mounted on the cam ring and located within a recess 29 formed in the piston and extending through an aperture in the wall of the cylinder. The piston is urged in one direction by means of a coiled compression spring 26 and is moved in the opposite direction to advance the timing of the delivery of fuel by means of fuel under pressure obtained from the outlet of the pump 21. The fuel under pressure is supplied through a passage 27 and the adjacent end of the cylinder is closed by a closure 28. In use, as the output pressure of the feedpump increases, the piston is moved against the action of the spring 26 to advance the timing of delivery of fuel.

The piston 25 in its face directed towards the closure 28 is provided with a pair of diametrically opposed slots 30 and for co-operation with the slots, tangs 31 are provided, these extending from the presented face of a first annular member 32. The member 32 is mounted about a retaining screw 33 which is secured within an angularly movable shaft 34. The shaft 34 defines a second member 35 having a face presented to the first member 32. The member 35 is provided with tangs 36 extending towards the member 32 and this latter member is provided with slots 37 in its face presented to the first member. As will be seen from FIG. 3 the slots 37 have a greater width than the tangs 36 and also the slots are of varying depth. A spiral spring acts between the members 32 and 35 in a direction to bias the tangs 36 towards the shallower ends of the slots 37.

The angularly movable shaft 34 has connected to it a lever 38 and this through linkage (not shown) is connected to the lever 23. FIG. 3 shows the members in three different settings, the upper setting being obtained when the pump is at rest and with the piston urged its maximum extent towards the left by means of the spring 26. It will be observed that the end face of the piston 25 is in contact with the adjacent face of the first member 32 whilst the tangs 36 are at the shallower ends of the slots 37 with the end faces of the tangs engaging with the base walls of the slots.

When the engine is cold the operator moves the aforesaid control to the operative position and as previously mentioned this moves the lever 23 to a position in which an increased quantity of fuel will be supplied for idling purposes. In addition, movement of the lever 38 causes movement of the member 35 towards the left as seen in FIG. 3, it being appreciated that FIG. 3 is a developed view of the piston and members. Movement of the second member 35 towards the left is seen in the middle view and it will be observed that the tangs 36 have moved towards the deeper ends of the slots 37, against the action of the spring. The fact that the slots are of varying depths means that the first and second member 32, 35 move closer to each other with the piston 25 exerting a force due to the spring 26. The practical effect is that the piston moves downwardly a distance indicated by the letter A i.e. towards the left as seen in FIG. 2 thereby retarding the delivery of fuel by an amount corresponding to the distance A.

When the engine starts and fuel under pressure is applied to the piston 25, the latter moves away from the first member 32 to disengage the tangs 31 from the slots 30. Once disengagement has occured the spiral spring effects movement of the first member 32 relative to the member 35 and the tangs 36 are moved to the shallower ends of the slots 37. The practical effect is that once the engine has attained its idling speed following a period when it will have exceeded the idling speed due to the supply of excess fuel for starting purposes, the piston engages the presented faces of the tangs 31 under the action of the spring 26 so that the timing of delivery of fuel to the engine is advanced by an amount B as compared with the rest position and by an amount A+B as compared with the timing of delivery for starting purposes.

Once the operator of the engine has decided that the engine has attained a temperature sufficient to enable it to idle normally, the control is returned to its inoperative position and the lever moves to reduce the amount of fuel supplied for idling purposes. At the same time the lever 38 is moved to restore the second member to its original position and if the engine is still idling the piston 25 will assume the upper position shown in FIG. 3. FIG. 2 shows the piston in two positions, the upper position corresponding to the uppermost setting shown in FIG. 3 and the lower position corresponding to the lowermost setting shown in FIG. 3.

With the mechanism described it is essential to ensure that when the piston 25 moves under the action of fuel pressure, the first member 32 is maintained in contact through the tangs and slots, with the second member 35.

It will be appreciated that the slots 30 could be formed in the member 32 and the tangs 31 formed in the piston with the slots 37 being formed in the member 35 and the tangs 36 being formed on the member 32. It is also possible to form the tangs 31 on the member 35 and the slots 30 in the presented face of the member 32 with the slots 37 being formed in the piston and the tangs 36 being formed on the member 32. In this case however it is necessary to ensure that the second member moves with the piston when the latter moves under the action of fuel pressure.

The operator adjustable control connected to the lever 23 may be replaced by an engine temperature responsive device so that the setting of the levers 23 and 38 for cold idling purposes is obtained automatically.

I claim:

1. A fuel pumping apparatus for supplying fuel to a compression ignition engine and of the kind comprising an injection pump operable in use, in timed relationship with the associated engine to deliver fuel at predetermined time intervals, the injection pump including a component the position of which can be altered to adjust the timing relationship between the injection pump and the engine, an engine speed responsive member operably connected to said component and which with increasing engine speed moves said component in a direction to advance the timing of delivery of fuel by the injection pump, fuel control means for controlling the amount of fuel delivered by the injection pump and lever means associated with said fuel control means and operable to increase the amount of fuel delivered by the injection pump for the purpose of obtaining satisfactory idling of the engine when the engine is cold, a first member positioned adjacent said speed responsive member, a second member positioned adjacent said first member, means coupling said second member to said lever means whereby when said lever means is moved in a direction to increase the delivery of fuel for cold idling purposes, said second member will be moved in a plane normal to the direction of movement of said speed responsive member, first tang and slot elements defined by the presented faces of the speed responsive member and the first member, second tang and slot elements defined by the presented faces of the first and second members, one of said tang and slot elements having the slot wider than the tang and of varying depth and resilient means acting between the one pair of members defining the aforesaid one tang and slot elements, said resilient means acting to urge the members in a direction such that the tang is disposed at the shallower end of the slot, the arrangement being such that when said lever means is moved to increase the delivery of fuel the aforesaid one pair of members move relative to each other so that the tang moves to the deeper end of the slot thereby allowing the one pair of members to move closer to each other so that the timing of delivery of fuel is retarded, and when the engine starts the members defining the other of said tang and slot elements move away from each other to disengage the other tang and slot elements while the one pair of members move relative to each other under the action of the resilient means thereby providing advance of the timing of delivery of fuel for cold idling of the engine.

2. An apparatus according to claim 1 in which said speed responsive member comprises a fluid pressure operable piston mounted for axial movement within a cylinder, the apparatus including an end closure for said cylinder and the end closure mounting an angularly movable shaft which is coupled to said lever means.

3. An apparatus according to claim 2 in which said second member is mounted on said shaft so as to move angularly therewith, said first member being of annular form and being mounted for angular movement about a bolt secured in said shaft.

4. An apparatus according to claim 3 in which the slot of said first tang and slot elements is the one of varying depth and is wider than the associated tang.

* * * * *